US005808393A

United States Patent [19]

Penfold et al.

[11] Patent Number: 5,808,393

[45] Date of Patent: Sep. 15, 1998

[54] BRUSH HOLDER FOR PRODUCING A CONSTANT BRUSH PRESSURE

[75] Inventors: Wayne C. Penfold, Glenview; Craig H. Scott, Prospect Heights; David J. Stapleton, Wood Dale, all of Ill.

[73] Assignee: MPC Products Corporation, Niles, Ill.

[21] Appl. No.: 862,750

[22] Filed: May 23, 1997

[51] Int. Cl.[6] ..... H01R 39/38

[52] U.S. Cl. ..... 310/242; 310/239; 310/246; 310/240; 310/245

[58] Field of Search ..... 310/239, 242, 310/246, 240, 245

[56] References Cited

U.S. PATENT DOCUMENTS

| | | | |
|---|---|---|---|
| 3,983,432 | 9/1976 | Rankin | 310/242 |
| 4,868,441 | 9/1989 | Bulick | 310/239 |
| 4,994,701 | 2/1991 | Bulick | 310/239 |
| 5,059,846 | 10/1991 | Concannon | 310/239 |
| 5,397,952 | 3/1995 | Derker et al. | 310/242 |

*Primary Examiner*—Thomas M. Dougherty
*Assistant Examiner*—Thanh Lam
*Attorney, Agent, or Firm*—Laff, Whitesel, Conte & Saret, Ltd.

[57] ABSTRACT

A brush holder assembly comprises a non-conductive brush holder body covered by a printed wiring board cover. The brush holder body includes a brush cavity for holding a brush, a spring cavity for holding a spring and a shunt wire cavity for holding a shunt wire. The spring is configured to hold the brush in contact with a commutator at a constant brush pressure throughout the entire length of brush travel. The brush holder body and printed wiring board cover are configured to enclose the brush, spring and shunt wire thus protecting the brush, spring and shunt wire.

11 Claims, 3 Drawing Sheets

BRUSH HOLDER FOR PRODUCING A CONSTANT BRUSH PRESSURE

FIELD OF THE INVENTION

The present invention relates to brush holders for brush torque motors. More particularly, the present invention relates to brush holders which produce a constant brush pressure on a brush torque motor commutator.

BACKGROUND INFORMATION

Brush holders are typically used for holding brushes in contact with commutators in brush torque motors. Prior art brush holder assemblies typically employ nonconstant-force leaf springs to urge the brush toward to the communtator and to conduct electrical current to the brush. Alternative prior art assemblies include a shunt wire for conducting electrical current to the brush instead of using the spring.

U.S. Pat. No. 5,059,849 issued to Concannon discloses a brush holder for facilitating service to the brush and brush holder. The disclosed brush holder comprises a body element semi-permanently secured to the machine housing, and a cartridge element, configured to hold a plurality of brushes detactably secured to the body element. Twin-coil spring elements are contained with coil compartments for urging the brushes into resilient engagement with the commutator segments of the machine.

The Concannon brush holder employs a "through-the-cartridge" design in which the rear end of the brushes as well as the brush conducting leads are exposed through the open rear end of the cartridge element when installed in the cartridge element. The conducting leads are connected to terminals on an outward side of the cartridge element.

U.S. Pat. No. 4,994,701 issued to Bulick discloses a brush holder assembly which utilizes an insulated brush card and bridge means to define a receiving aperture for a brush element. The bridge means is defined by a connecting plate element and a pair of legs which extend from the connecting plate to the brush card forming a bridge over the brush. The connecting plate includes a guide-way slot for receiving the brush lead wire and providing a guide to subsequent movement of the brush as it wears during its life within the brush holder.

The Bulick brush holder is designed to include a retaining mechanism for both the constant force spring and the brush in a fully retracted position prior to assembly into a machine. The constant force spring is disclosed as including twin helical coils mounted to encircle the pair of legs. When installed in the brush holder, the brush sides, spring coil and lead wire are exposed through the sides of the bridge means.

U.S. Pat. No. 3,983,432 issued to Rankin discloses a brush holder assembly which facilitates maintenance by affording ready removal and replacement of the brushes without requireing disassembly of the machine. The brush holder comprises a guideway means of electrically insulated material which is secured to the machine housing. The guideway means comprises a tubular plastic insert including a slot for receiving the brush lead wire. A spring coil is also provided for urging the brush into engagement with the motor armature. The brush, spring coil, and lead wire are all exposed when installed in the brush holder which is in turn secured to the machine housing.

U.S. Pat. No. 5,397,952 issued to Decker discloses a brush holder for mechanically commutated electric motors. The brush holder comprises a support plate, mounted to a shaft-like guiding container. The brush is installed in the shaft of the guiding container and is urged into communication with the collector of an electric motor by a pressing spring. The guiding container further includes a guiding slot for receiving the brush lead wire. When assembled and installed in the motor, the Decker brush holder leaves the brush, spring coil, and lead wire exposed.

While the above-mentioned devices may be suited for their intended usage, none of these devices provide sufficient protection for the brush, spring and shunt wire. The above-mentioned devices act merely to hold the brush and associated components in place. Thus, it is apparent there is a need for an improved brush holder.

An object of the present invention is providing a brush holder assembly for protecting the brush, spring and shunt wire while producing a constant brush pressure on a brush torque motor commutator.

SUMMARY OF THE INVENTION

According to the present invention, the foregoing and other objects and advantages are attained by a brush holder assembly comprising 1) a brush cavity, 2) a spring cavity and 3) a shunt wire cavity which are completely enclosed thus protecting the brush, spring and shunt wire.

The brush holder assembly comprises a non-conductive brush holder body and a cover. In the preferred embodiment, the cover comprises a printed wiring board for electrically connecting the shunt wire and brush to a control means for controlling brush operation. A terminal lug can be included in the shunt wire cavity for electrically connecting the shunt wire to the printed wiring board. The terminal lug is configured to extend through the brush holder body and is connected to the shunt wire and printed wiring board by solder joints.

The brush cavity is configured to receive a brush with the brush body disposed in the brush cavity and with the end of the brush which contacts the commutator extending through an opening in the end of the brush cavity. The brush cavity is rectangular and sized to accommodate the brush over the entire usable length of the brush.

The spring cavity is configured to receive a spring. The spring cavity is arranged in communication with the brush cavity such that when the spring is placed in the spring cavity, the spring engages the brush holding the brush in contact with the commutator. In the preferred embodiment, the spring cavity comprises two spring end cavities, one each disposed on opposing sides of the brush cavity, for holding the rolled-up ends of a clock spring with the brush engaging spring portion disposed in the brush cavity.

The shunt wire cavity is configured to receive the shunt wire. The shunt wire cavity comprises a terminal lug cavity and a wire path cavity. The terminal lug cavity is configured to receive the terminal lug and to temporarily hold excess shunt wire. The wire path cavity places the terminal lug cavity in communication with the brush cavity. When installed in the brush holder, the shunt wire extends from the terminal lug through the wire cavity to the brush, with excess shunt wire being stored in the terminal lug cavity. As the brush wears, the excess shunt wire is advanced from the terminal lug cavity into the wire cavity and subsequently the brush cavity.

In the preferred embodiment, the brush holder assembly is configured to hold a plurality of brushes, springs and shunt wires.

These as well as other novel advantages, details, embodiments, features and objects of the present invention will be apparent to those skilled in the art from the following detailed description of the invention, the attached claims and accompanying drawings, listed hereinbelow, which are useful in explaining the invention.

BRIEF DESCRIPTION OF THE DRAWINGS

In the text which follows and in the drawings, wherein similar reference numerals denote similar elements throughout the several views thereof, the present invention is explained with reference to illustrative embodiments, in which.

DETAILED DESCRIPTION OF THE INVENTION

Figure 1:
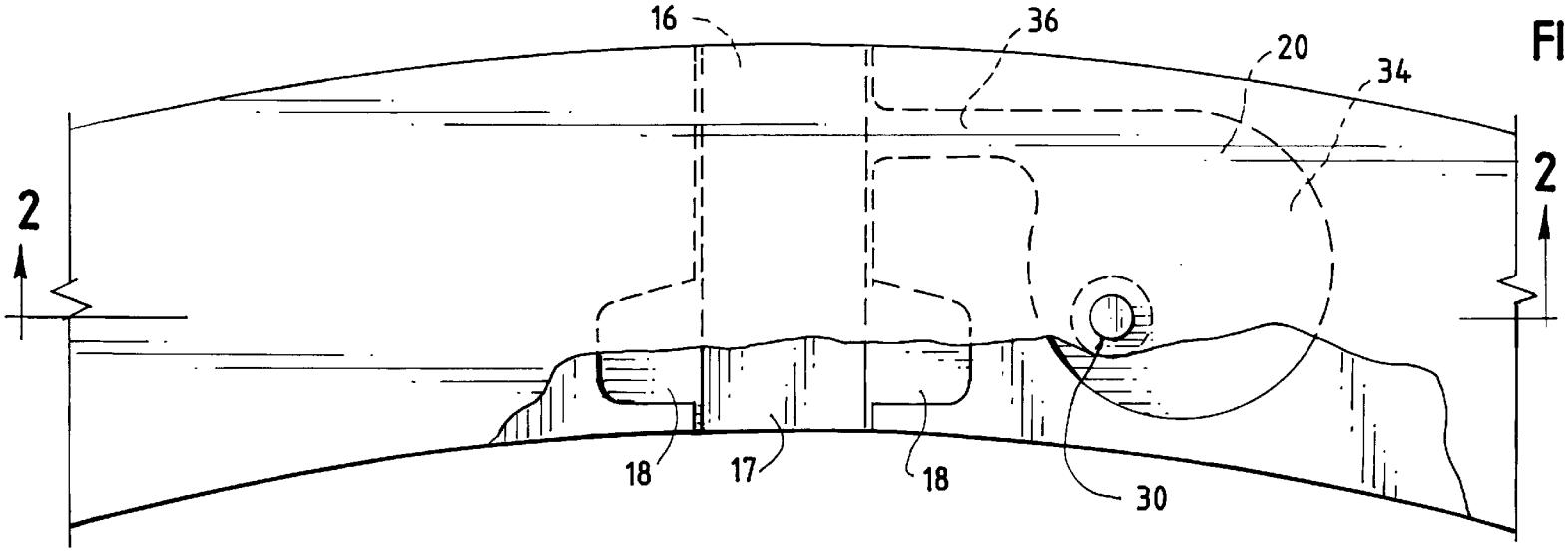
FIG. 1 is a top view of a section of a preferred embodiment of the brush holder body of the present invention.
Figure 2:
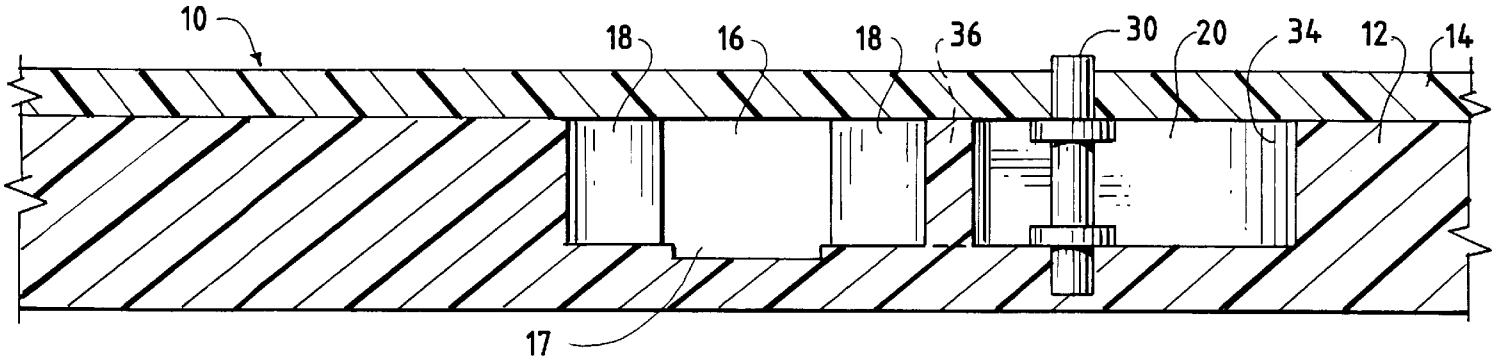
FIG. 2 is a front cross-sectional view of a section of brush holder assembly of the present invention.
Figure 3:
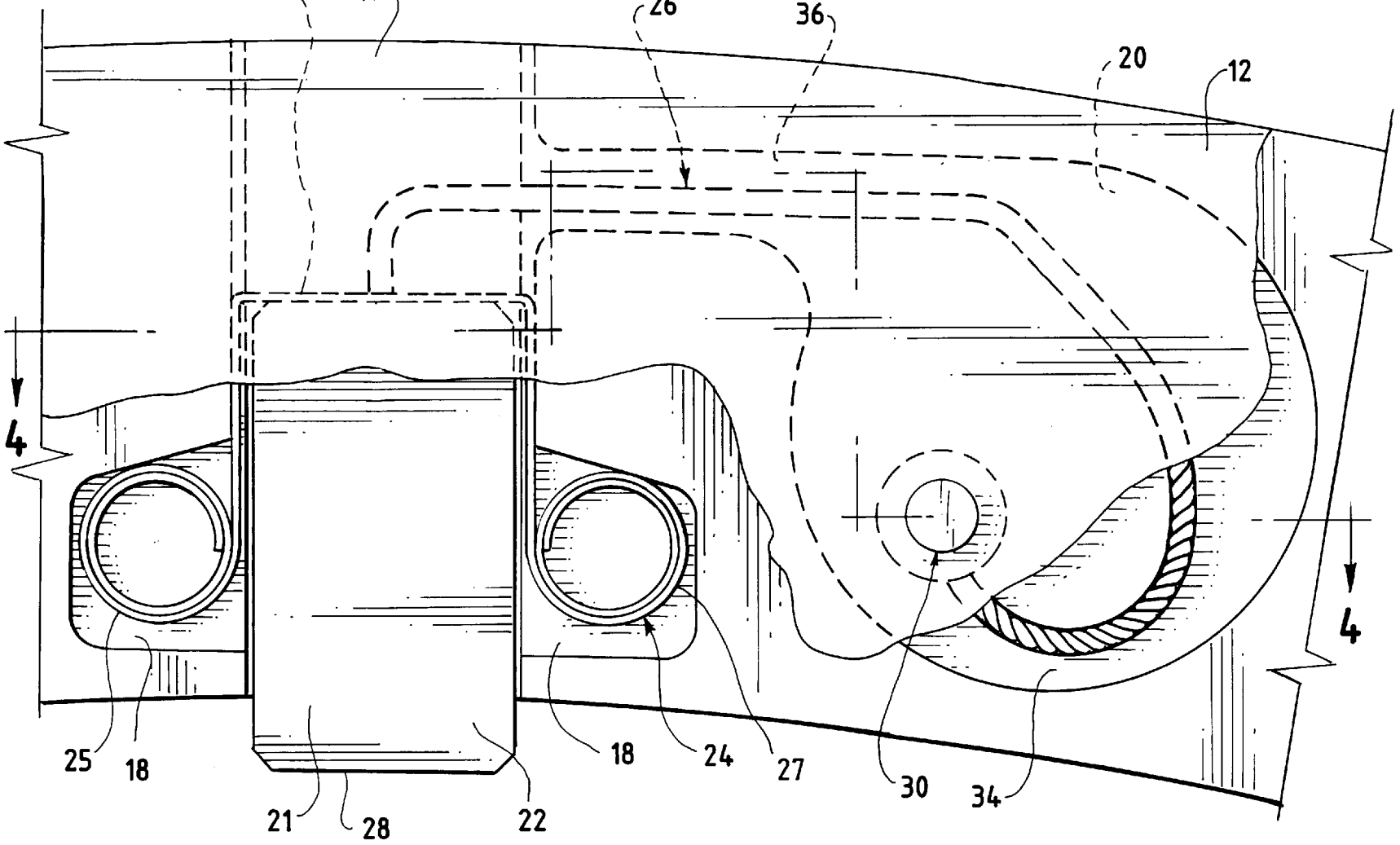
FIG. 3 is a top view the brush holder body of FIG. 1 including an installed brush, spring and shunt wire.
Figure 4:
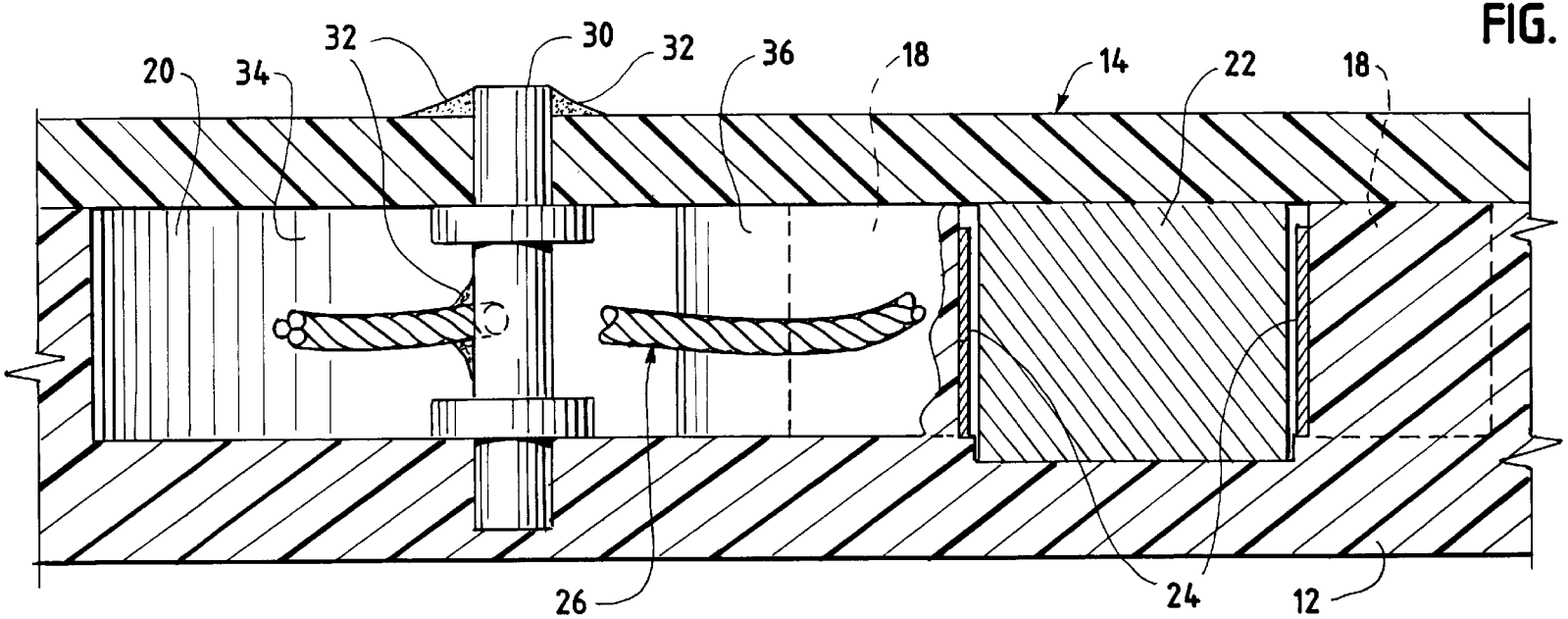
FIG. 4 is a side cross-sectional view of a section of a preferred embodiment of the brush holder assembly of the present invention including an installed brush, spring and shunt wire.

For a better understanding of the present invention, reference may be had to the following detailed description taken in conjunction with the accompanying drawings. Each reference numeral is consistent throughout all of the drawings.

Referring now to the drawings, the brush holder assembly, indicated generally at 10, comprises a brush holder body 12 and a cover 14. Brush holder body 12 includes a brush cavity 16 having a brush opening 17, a spring cavity 18 and a shunt wire cavity 20. Cover 14 comprises a printed wiring board configured for providing an electrical connection between brush holder assembly 10 and a control means for controlling the operation of the brush and brush holder assembly 10.

In operation, a brush 22 is installed in brush cavity 16, a spring 24 is installed in spring cavity 18 and a shunt wire 26 is installed in shunt wire cavity 20. Brush 22 has a brush body 21 and a commutator end 28. When brush 22 is properly installed in brush holder assembly 10, commutator end 28 extends out of brush opening 17. Commutator end 28 is configured to contact a rotating commutator (not shown). As the commutator rotates, brush 22 wears.

Spring 24 is configured to hold brush 22 in contact with the commutator. In the preferred embodiment, spring 24 is a multiple-turn, rolled-end, clock spring. Spring 24 comprises a pair of multiple-turn, rolled-up ends 25, 27 connected by a brush engaging portion 29. Brush engaging portion 29 engages brush 22 and as brush 22 wears, spring 24 urges brush 22 forward through brush opening 17. Spring 24 provides a constant force over the entire length of brush travel.

Shunt wire 26 is configured to provide an electrical connection between brush 22 and printed wiring board cover 14. In the preferred embodiment, shunt wire 26 is formed integral with brush 22 extending from the end of the brush opposite commutator end 28. Shunt wire 26 is configured with excess length to accommodate movement of brush 22 over the entire length of brush travel.

A terminal lug 30 is provided which runs through brush holder body 12. Solder 32 is used to electrically connect terminal lug 30 to printed wiring board cover 14 and shunt wire 26. Thus, terminal lug 30 electrically connects brush 22 to printed wiring board cover 14 though shunt wire 26.

In the preferred embodiment, brush cavity 16 is rectangular in shape. Brush cavity 16 has a brush opening 17 at one open end and is enclosed on the opposite end by brush holder body 12. Brush cavity 16 is configured to receive brush 22 and is long enough to accommodate brush body 21 through the entire length of brush travel.

Spring cavity 18 comprises a pair of spring end cavities in communication with brush cavity 16. The spring end cavities are disposed on opposite sides of brush cavity 16 and are configured for receiving rolled-up spring ends 25,27 with brush engaging portion 29 extending into and bridging across brush cavity 16.

Shunt wire cavity 20 comprises a terminal lug cavity 34 and a wire path cavity 36. Wire path cavity 36 extends from terminal lug cavity 34 to brush cavity 16 placing terminal lug cavity 34 in communication with brush cavity 16. Terminal lug 30 is disposed in terminal lug cavity 34. Shunt wire 26 runs from terminal lug 30 through wire path cavity 36 into brush cavity 16 where it is connected to brush 22. Excess shunt wire 26 is stored in terminal lug cavity 34. Shunt wire 26 is configured to be long enough to extend through the entire length of brush travel with excess shunt wire 26 being stored in terminal lug cavity 34.

Figure 5:
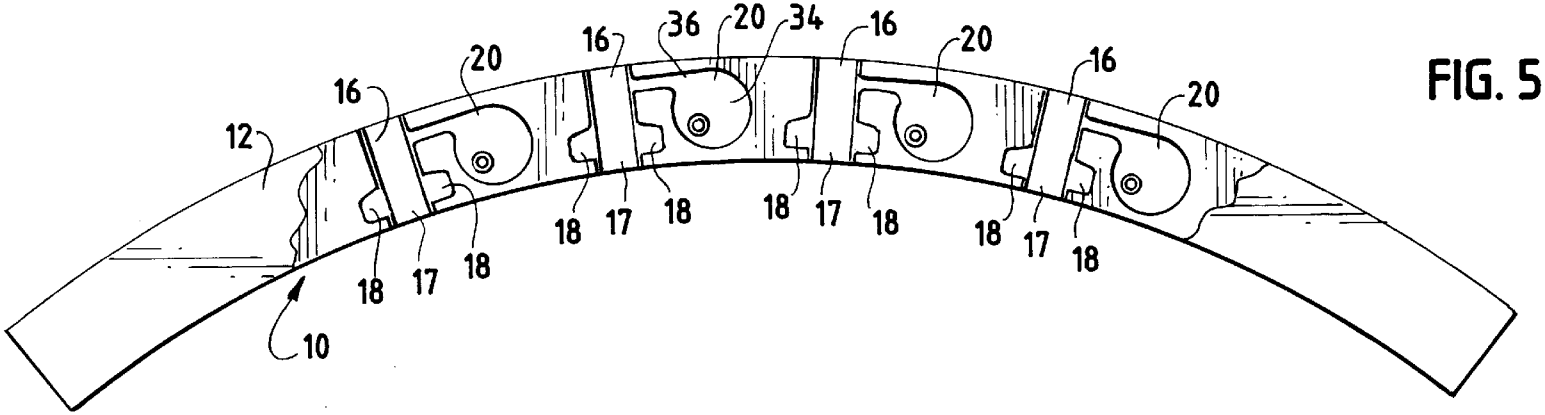
FIG. 5 is a top view of a preferred embodiment of the brush holder body of present invention, showing multiple brush, spring and wire cavities.

FIG. 5 illustrates a brush holder assembly 10 configured to hold multiple brushes 22, springs 24 and shunt wires 26. The brush holder assembly of FIG. 5 comprises multiple brush cavities 16, spring cavities 18 and shunt wire cavities 20.

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention as set forth in the appended claims. All are considered within the sphere, spirit, and scope of the invention. The specification and drawings are, therefore, to be regarded in an illustrative rather than restrictive sense. Accordingly, it is not intended that the invention be limited except as may be necessary in view of the appended claims.

We claim:

1. A brush holder assembly for use with an electric motor comprising a brush, a commutator, a spring and a shunt wire, wherein said brush comprises a brush body having a commutator contact end disposed at one end of the brush body, the brush holder assembly comprising:

a housing having:

a brush cavity for receiving the brush with the brush body disposed in said brush cavity with the brush body commutator end exposed;

a spring cavity in communication with said brush cavity for receiving the spring such that the spring engages the brush holding the brush in contact with the commutator; and a shunt wire cavity in communication with said brush cavity for receiving the shunt wire such that the shunt wire provides an electrical current to the brush, wherein said housing completely encloses the brush body, spring and shunt wire when a brush is installed in the brush cavity, protecting the brush body, spring and shunt wire.

2. The brush holder assembly of claim 1 wherein said housing further comprises a brush holder body and a cover, said brush holder body comprising said bush cavity, said spring cavity and said wire cavity and said cover comprising a printed wiring board for electrically connecting said brush holder assembly to control means.

3. The brush holder assembly of claim 2 further comprising a terminal lug disposed in said wire cavity extending through said brush holder body for electrically connecting said shunt wire to said printed wiring board.

4. The brush holder of claim 3 said wire cavity further comprising a terminal lug cavity and a wire path cavity, said terminal lug being disposed in said terminal lug cavity, said wire path cavity communicating with said brush cavity connecting said brush cavity to said terminal lug cavity, wherein the shunt wire connects the brush to said terminal lug, the shunt wire being long enough to provide for travel of the brush toward the commutator as the brush wears, with excess shunt wire being held in said terminal lug cavity and extended into said brush cavity through said wire path cavity as the brush moves toward the communtator.

5. The brush holder assembly of claim 1 wherein said spring comprises a clock spring having at least two multiple-turn, rolled-up ends connected by a brush engaging spring portion, said clock spring for providing a constant force on said brush.

6. The brush holder assembly of claim 5 wherein said spring cavity comprises at least two spring end cavities at least one said spring end cavity disposed on each side of said brush cavity, said spring end cavities configured for receiving said rolled-up spring ends.

7. The brush holder assembly of claim 1 wherein the shunt wire is configured integral with the brush extending from an end of the brush opposite the commutator contact end.

8. The brush holder assembly of claim 1 wherein said brush cavity is rectangular and has an open brush commutator end, said spring cavity comprises two spring end cavities said spring end cavities disposed one each on opposing sides of said brush cavity and said wire cavity comprising a terminal lug cavity and a wire path cavity, said wire path cavity communicating with said brush cavity near an end of said brush cavity opposite said open brush commutator end, said wire path cavity connecting said brush cavity to said terminal lug cavity.

9. The brush holder assembly of claim 2 further comprising a terminal lug extending through said brush holder body for electrically connecting said shunt wire to said printed wiring board, said shunt wire being configured integrally with the brush extending from an end of the brush opposite the commutator contact end, said spring further comprises a clock spring having two multiple-turn, rolled-up ends connected by a brush engaging spring portion, wherein said brush cavity is rectangular and has an open brush commutator end such that the brush communtator contact end extends from said brush cavity, said spring cavity further comprises two spring end cavities, said spring end cavities disposed one each on opposing sides of said brush cavity and said wire cavity comprising a terminal lug cavity and a wire path cavity, said terminal lug disposed in said terminal lug cavity, said wire path cavity communicating with said brush cavity near an end of said brush cavity opposite said open brush commutator end, said wire path cavity connecting said brush cavity to said terminal lug cavity.

10. The brush holder assembly of claim 1 further comprising a plurality of brush cavities, spring cavities and wire cavities for holding a plurality of brushes, springs and shunt wires.

11. The brush holder assembly of claim 2 wherein said brush holder body is non-conductive.

* * * * *